US007293494B2

(12) United States Patent
Morency et al.

(10) Patent No.: US 7,293,494 B2
(45) Date of Patent: Nov. 13, 2007

(54) EXPANDABLE HYDRAULIC VALVE STACK

(75) Inventors: Christopher Michael Morency, Naperville, IL (US); Edward Lee Stapleton, Joliet, IL (US); Wesley Thomas Payne, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/019,311

(22) Filed: Dec. 23, 2004

(65) Prior Publication Data

US 2006/0137518 A1 Jun. 29, 2006

(51) Int. Cl.
*F01B 29/04* (2006.01)
*F15B 13/00* (2006.01)

(52) U.S. Cl. ..... 91/54; 60/458; 137/884

(58) Field of Classification Search ..... 60/327, 60/422, 458; 91/54; 137/884
See application file for complete search history.

(56) References Cited

U.S. PATENT DOCUMENTS 4,664,220 A 5/1987 Ruhter et al.
5,115,835 A * 5/1992 Ueno ..... 60/427
5,490,385 A * 2/1996 Stoll et al. ..... 137/844
5,577,435 A 11/1996 Kowalyk et al.
5,622,206 A * 4/1997 Takeuchi et al. ..... 137/884
5,673,557 A * 10/1997 Yoshida et al. ..... 60/422
6,018,895 A 2/2000 Duppong et al.
6,029,446 A 2/2000 Duppong et al.
6,357,230 B1 3/2002 A'Hearn et al.

* cited by examiner

*Primary Examiner*—Michael Leslie
(74) *Attorney, Agent, or Firm*—Finnegan, Henderson, Farabow, Garrett & Dunner

(57) ABSTRACT

A hydraulic valve stack for a work machine is disclosed. The hydraulic valve stack has a base with a first mounting surface and a second mounting surface. The base is connectable to the work machine and has at least one fluid passageway extending through the base from the first mounting surface to the second mounting surface. The hydraulic valve stack also has a permanent valve assembly configured to control a permanent function of the work machine and an optional valve assembly configured to control an optional function of the work machine. The permanent valve assembly is connectable to the first mounting surface of the base, while the optional valve assembly is connectable to the second mounting surface of the base. Each of the permanent and the optional valve assemblies have at least one fluid passageway in communication with the at least one fluid passageway of the base.

38 Claims, 2 Drawing Sheets

EXPANDABLE HYDRAULIC VALVE STACK

TECHNICAL FIELD

The present disclosure relates generally to a hydraulic valve stack and, more particularly, to an expandable hydraulic valve stack.

BACKGROUND

Work machines such as wheel loaders, integrated tool carriers, skid-steer loaders, agricultural tractors, and other work machines have a variety of work tools that may be attachable to the work machine to perform different tasks. These work tools may be hydraulically actuated and require valve assemblies that are in fluid communication with a pump and a tank. When multiple work tools are simultaneously attached to the work machine, fluid communication between the separate valve assemblies and the pump and tank may be difficult and require complex and expensive routing of hydraulic fluid conduits.

One method of reducing the complexity and cost associated with fluidly and simultaneously communicating the multiple work tools with a common pump and tank may include bringing together the separate valve assemblies into a valve stack having a common fluid supply passageway and a common return passageway. The common supply passageway of the valve stack may be fluidly communicated with the pump via a first common hydraulic fluid conduit, while the common return passageway may be fluidly communicated with the tank via a second common hydraulic fluid conduit. One such method is described in U.S. Pat. No. 4,664,220 (the '220 patent) issued to Ruhter et al. on May 12, 1987. The '220 patent describes a stack of functional control valves mounted together in a transverse side-by-side arrangement. Each of the control valves has a hydraulic fitting operably connecting the valve to its respective functional element of a vehicle.

Although the valve stack of the '220 patent may reduce some the complexity and cost involved with fluid communication of multiple control valves, the mounting configuration of these valves may be problematic. For example, as illustrated in FIG. 2 of the '220 patent, the functional control valves are held together by bolts that extend from one side of the stack to the other side of the stack for threaded engagement with nuts, thereby sandwiching the entire stack of control valves between the bolts and nuts. In this configuration, in order to expand the stack by assembling additional control valves to the stack, the entire stack of control valves must be disassembled. Each time the stack of control valves is disassembled, contamination may be introduced into the valve stack, which can shorten component life of the control valves and possibly cause malfunction. In addition, because the entire stack must be taken apart, the process of expansion can be time and labor intensive, and can increase the likelihood of improper assembly.

The disclosed hydraulic valve stack is directed to overcoming one or more of the problems set forth above.

SUMMARY OF THE INVENTION

In one aspect, the present disclosure is directed to a hydraulic valve stack for a work machine. The hydraulic valve stack includes a base having a first mounting surface and a second mounting surface. The base is connectable to the work machine and has at least one fluid passageway extending through the base from the first mounting surface to the second mounting surface. The hydraulic valve stack also includes a permanent valve assembly configured to control a permanent function of the work machine. The permanent valve assembly is connectable to the first mounting surface of the base and has at least one fluid passageway in communication with the at least one fluid passageway of the base. The hydraulic valve assembly further includes an optional valve assembly configured to control an optional function of the work machine. The optional valve assembly is connectable to the second mounting surface of the base and has at least one fluid passageway in communication with the at least one fluid passageway of the base.

In another aspect, the present disclosure is directed to a method of expanding a hydraulic valve stack having at least one permanent valve assembly connected to a base. The method includes removing an end plate from the valve stack while the at least one permanent valve assembly remains connected to the base. The method also includes operatively connecting an optional valve assembly to the base and reassembling the end plate.

In yet another aspect, the present disclosure is directed to a method of maintaining a hydraulic valve stack having at least one permanent valve assembly connected to a base. The method includes removing one of an end plate and an inlet cover from the hydraulic valve stack while at least one of the at least one permanent valve assembly and the at least one optional valve assembly remains connected to the base. The method further includes accessing one of the at least one permanent and the at least one optional valve assembly and reassembling the one of the end plate and the inlet cover.

DETAILED DESCRIPTION

Figure 1:
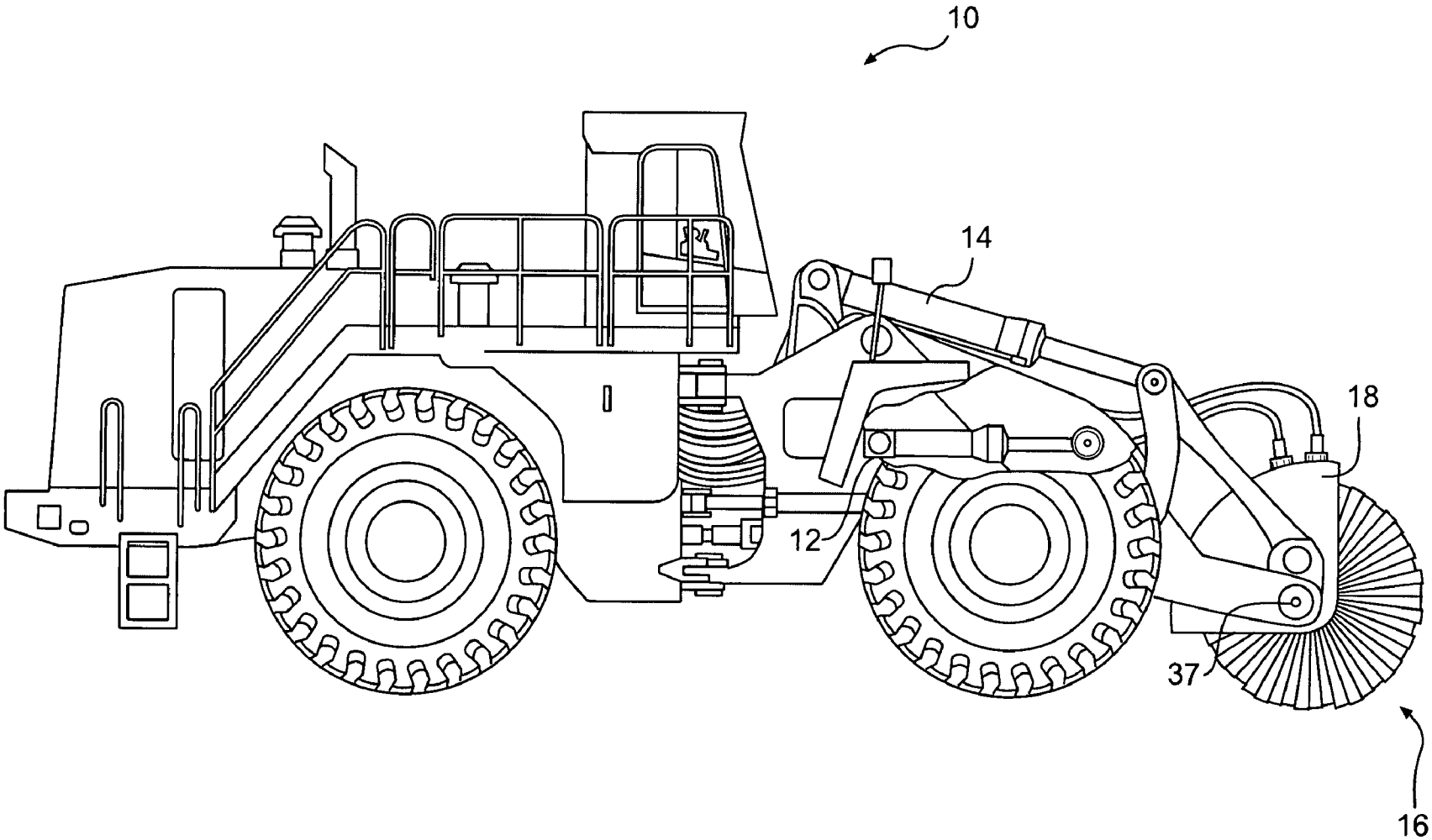
FIG. 1 is a diagrammatic illustration of an exemplary disclosed work machine.

FIG. 1 illustrates an exemplary work machine 10. Work machine 10 may be a fixed or mobile machine that performs some type of operation associated with an industry such as mining, construction, farming, or any other industry known in the art. For example, work machine 10 may be a wheel loader, a backhoe, an integrated tool carrier, a skid-steer loader, or any other work machine known in the art. Work machine 10 may include first and second permanent fluid actuators 12, 14 configured to couple a work implement 16 to work machine 10, and an optional fluid actuator 18. For the purpose of this disclosure, the phrase "permanent fluid actuator" may include an actuator included as standard equipment with newly-produced work machines 10. Conversely, the phrase "optional fluid actuator" may include an actuator that is not necessarily included as standard equipment with newly-produced work machines 10, but selectable by a particular customer or operator for use with work machine 10. It is contemplated that work machine 10 may include a different number of fluid actuators than depicted in FIG. 1.

Figure 2:
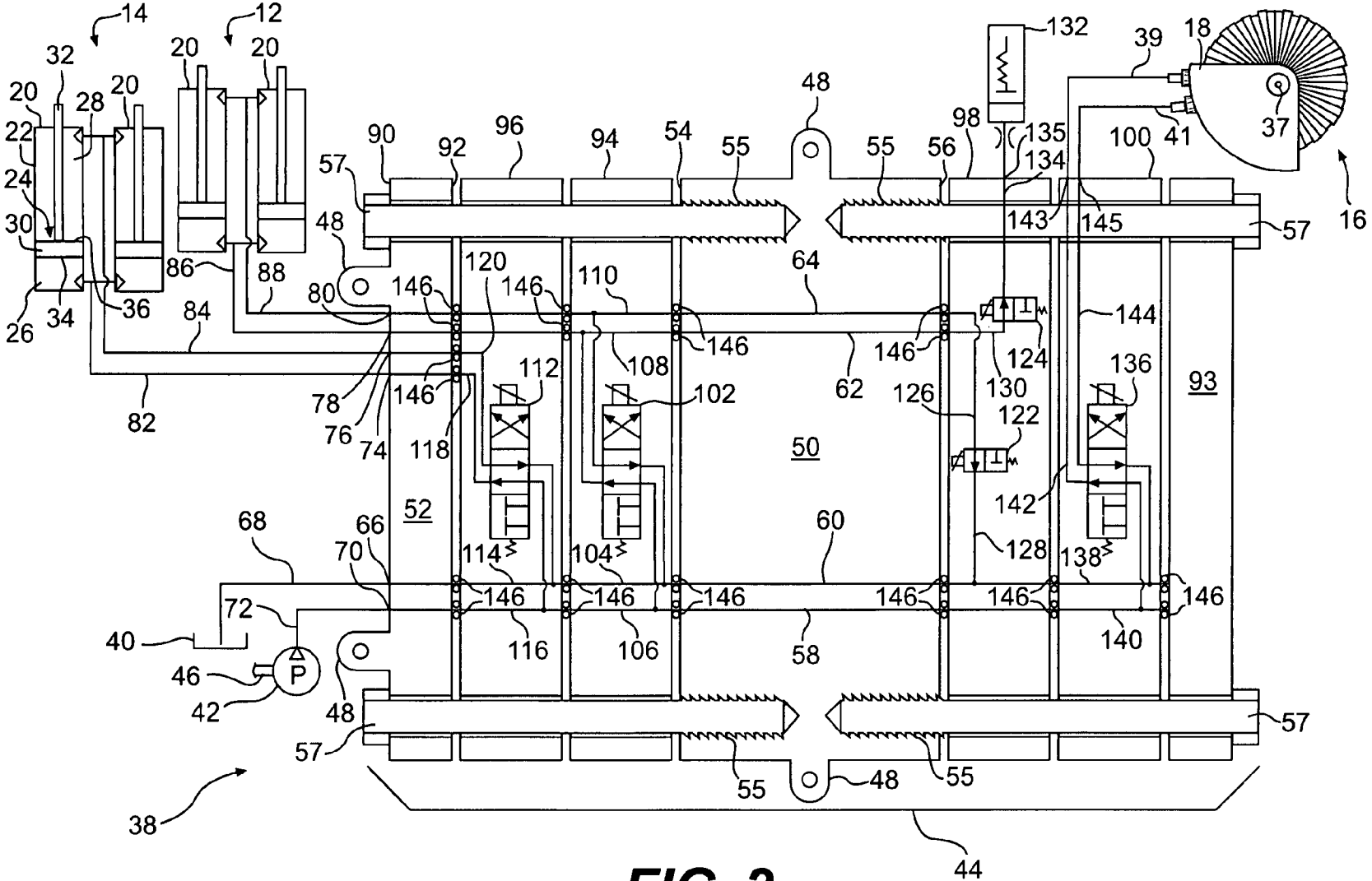
FIG. 2 is a diagrammatic and schematic illustration of an exemplary disclosed hydraulic valve stack for the work machine of FIG. 1.

As illustrated in FIG. 2, first and second permanent fluid actuators 12 and 14 may each include a pair of hydraulic cylinders 20. Hydraulic cylinders 20 may connect work implement 16 to a frame (not shown) of work machine 10 via a direct pivot, via a linkage system with each of hydraulic cylinders 20 forming one or more members in the linkage system, or in any other appropriate manner. Each of hydraulic cylinders 20 may include a tube 22 and a piston assembly 24 disposed within tube 22. One of tube 22 and piston assembly 24 may be pivotally connected to the frame, while the other of tube 22 and piston assembly 24 may be pivotally connected to work implement 16 or a linkage member that is connected to work implement 16. It is contemplated that tube 22 and/or piston assembly 24 may alternately be fixedly connected to either the frame or work implement 16, or connected between two or more members of the frame.

Each of hydraulic cylinders 20 may include a first chamber 26 and a second chamber 28 separated by piston assembly 24. First and second chambers 26, 28 may be selectively supplied with a pressurized fluid and drained of the pressurized fluid to cause piston assembly 24 to displace within tube 22, thereby changing the effective length of hydraulic cylinders 20. The expansion and retraction of hydraulic cylinders 20 may function to assist in moving work implement 16.

Piston assembly 24 may include a piston 30 axially aligned with and disposed within tube 22, and a piston rod 32 connectable to one of the frame and work implement 16. Piston 30 may include two opposing hydraulic surfaces, one associated with each of the first and second chambers. An imbalance of force created by fluid pressure acting on the two surfaces may cause piston assembly 24 to axially move within tube 22. For example, a force acting on a first hydraulic surface 34 being greater than a force acting on a second opposing hydraulic surface 36 may cause piston assembly 24 to displace and increase the effective length of hydraulic cylinders 20. Similarly, when a force acting on second hydraulic surface 36 is greater than a force acting on first hydraulic surface 34, piston assembly 24 may retract within tube 22 and decrease the effective length of hydraulic cylinders 20. A sealing member (not shown), such as an o-ring, may be connected to piston 30 to restrict a flow of fluid between an internal wall of tube 22 and an outer cylindrical surface of piston 30.

Work implement 16 may be one of a plurality of removably attachable work tools. In one embodiment work implement 16 may be a hydraulically operated broom. The broom may be raised and lowered by the expansion and retraction of hydraulic cylinders 20 associated with first permanent fluid actuator 12, tilted by the expansion and retraction of hydraulic cylinders 20 associated with second permanent fluid actuator 14, and rotated about an axis 37 by optional fluid actuator 18. It is contemplated that work implement 16 may alternatively be a removably attachable work tool other than a broom such as, for example, a snow plow, a side wing, an auger, a hammer, or any other suitable removably attachable work tool.

Optional fluid actuator 18 may be any hydraulically operated device configured to affect movement of work implement 16. As illustrated in FIG. 2, optional fluid actuator 18 may be a motor having a first passageway 39 and a second passageway 41. Pressurized fluid flowing into optional fluid actuator 18 from first passageway 39 may cause a clockwise rotation of work implement 16 about axis 37. Conversely, pressurized fluid flowing into optional fluid actuator 18 from second passageway 41 may cause a counterclockwise rotation of work implement 16. After passing from one of first and second passageways 39, 41 through the motor of optional fluid actuator 18, the pressurized fluid may drain to a tank 40 through the other of first and second passageways 39, 41. It is contemplated that pressurized fluid flowing from first passageway 39 through the motor of optional fluid actuator 18 may alternatively cause a counterclockwise rotation of the broom, and accordingly, that pressurized fluid flowing from second passageway 41 through the motor of optional fluid actuator 18 may cause a clockwise rotation of the broom.

Tank 40 may constitute a reservoir configured to hold a supply of fluid. The fluid may include, for example, a dedicated hydraulic oil, an engine lubrication oil, a transmission lubrication oil, or any other fluid known in the art. One or more hydraulic systems within work machine 10 may draw fluid from and return fluid to tank 40. It is also contemplated that hydraulic system 38 may be connected to multiple separate fluid tanks.

Work machine 10 may include a hydraulic system 38 having a plurality of fluid components that cooperate together to move the fluid actuators of work machine 10. Specifically, hydraulic system 38 may include a source 42 configured to pressurize the fluid, and a hydraulic valve stack 44 configured to selectively direct the pressurized fluid to and from hydraulic cylinders 20 and optional fluid actuator 18. It is contemplated that hydraulic system 38 may include additional and/or different components such as, for example, accumulators, restrictive orifices, check valves, pressure relief valves, makeup valves, pressure-balancing passageways, and other components known in the art.

Source 42 may be configured to produce a flow of pressurized fluid and may include a pump such as, for example, a variable displacement pump, a fixed displacement pump, a variable delivery pump, or any other source of pressurized fluid known in the art. Source 42 may be drivably connected to a power source (not shown) of work machine 10 by, for example, a countershaft 46, a belt (not shown), an electrical circuit (not shown), or in any other suitable manner. Alternately, source 42 may be indirectly connected to the power source via a torque converter (not shown), a gear box (not shown), or in any other appropriate manner. It is contemplated that multiple sources of pressurized fluid may be interconnected to supply pressurized fluid to hydraulic system 38.

Hydraulic valve stack 44 may be mounted to work machine 10 via one or more mounting flanges 48. In one example, hydraulic valve stack 44 may include a base member 50 having two mounting flanges 48, and an inlet cover 52 having two mounting flanges 48. Each mounting flange 48 may include a through hole configured to receive a fastener such as, for example, a bolt (not shown) that engages a threaded bore (not shown) within the frame of work machine 10. It is contemplated that a greater or lesser number of mounting flanges 48 may be included within hydraulic valve stack 44 and/or that mounting flanges 48 may be located in a different position.

Base member 50 may have multiple mounting surfaces and fluid passageways. Specifically, base member 50 may include a first mounting surface 54 and a second mounting surface 56 that is located on a side of base member 50 opposite first mounting surface 54. Each of first and second mounting surfaces 54, 56 may include one or more threaded bores 55 configured to receive one or more fasteners 57. A first fluid passageway 58, a second fluid passageway 60, a third fluid passageway 62, and a fourth fluid passageway 64 may be disposed within base member 50 and extend from first mounting surface 54 through base member 50 to second mounting surface 56. It is contemplated that first and second mounting surfaces 54 and 56 may be located on sides of base member 50 that are not opposite to each other and/or that base member 50 may include more than two mounting surfaces. It is also contemplated that fasteners 57 may alternatively be reversed, wherein fasteners 57 are fixed to base member 50 and configured to threadingly engage inlet cover 90 and end cover 93.

Inlet cover 52 may be fluidly connected to tank 40, source 42, and hydraulic cylinders 20. For example, inlet cover 52 may include a first external port 66 in fluid communication with tank 40 via a passageway 68, and a second external port 70 in fluid communication with source 42 via a passageway 72. Inlet cover 52 may also include a third external port 74, a fourth external port 76, a fifth external port 78, and a sixth external port 80 in fluid communication with first and second chambers 26, 28 of hydraulic cylinders 20 of first and second permanent fluid actuators 12 and 14 via fluid passageways 82, 84, 86, and 88, respectively. Each of the external ports of inlet cover 52 may extend from an exterior surface 90 through inlet cover 52 to an interior surface 92. It is contemplated that third, fourth, fifth, and sixth external ports 74-80 may alternatively be omitted, if desired, and permanent valve assemblies 94 and/or 96 include external ports in communication with hydraulic cylinders 20 of first and second permanent fluid actuators 12, 14.

Hydraulic valve stack 44 may include permanent valve assemblies connectable between interior surface 92 of inlet cover 52 and first mounting surface 54 of base member 50, and optional valve assemblies connectable between second mounting surface 56 of base member 50 and an end plate 93. In one example, hydraulic valve stack 44 may include a first permanent valve assembly 94 associated with first permanent fluid actuator 12, a second permanent valve assembly 96 associated with second permanent fluid actuator 14, a first optional valve assembly 98 associated with a ride control feature of work machine 10, and a second optional valve assembly 100 associated with optional fluid actuator 18. It is contemplated that additional or fewer permanent and optional valve assemblies may be included within hydraulic valve stack 44, that the location of first and second permanent valve assemblies 94, 96 may be interchangeable, and/or that the location of optional valve assemblies 98, 100 may be interchangeable.

First permanent valve assembly 94 may include at least one proportional valve element 102 configured to meter the flow of fluid to and from hydraulic cylinders 20 of first permanent fluid actuator 12. Specifically, proportional valve element 102 may be in fluid communication with passageway 68 via a passageway 104, with passageway 72 via a passageway 106, with fluid passageway 86 via a passageway 108, and with fluid passageway 88 via a passageway 110.

Proportional valve element 102 may be solenoid actuated against a spring bias to move between a first position at which pressurized fluid from source 42 is allowed to flow into one of first and second chambers 26, 28 of hydraulic cylinders 20 associated with first permanent fluid actuator 12, while allowing the fluid to drain from the other of first and second chambers 26, 28 to tank 40, a second position at which the flow directions are reversed, and a third position at which fluid flow is blocked from both of first and second chambers 26, 28. The location of proportional valve element 102 between the first, second, and third positions may determine a flow rate of the pressurized fluid directed into and out of first and second chambers 26, 28. It is contemplated that one proportional valve element 102 may control the filling and draining functions for both hydraulic cylinders 20 of first permanent valve assembly 12 or, alternatively, that two proportional valve elements 102 may be included within first permanent valve assembly 94 and associated with each hydraulic cylinder 20. It is also contemplated that proportional valve element 102 may alternatively be omitted and multiple independent metering valves implemented that control the filling and draining functions of each of first and second chambers 26, 28 for each hydraulic cylinder 20 within first permanent fluid actuator 12.

Second permanent valve assembly 96 may include at least one proportional valve element 112 configured to meter the flow of fluid to and from hydraulic cylinders 20 of second permanent fluid actuator 14. Specifically, proportional valve element 112 may be in fluid communication with passageway 68 via a passageway 114, with passageway 72 via a passageway 116, with fluid passageway 82 via a passageway 118, and with fluid passageway 84 via a passageway 120.

Proportional valve element 112 may be solenoid actuated against a spring bias to move between a first position at which pressurized fluid from source 42 is allowed to flow into one of first and second chambers 26, 28 of hydraulic cylinders 20 associated with second permanent fluid actuator 14, while allowing the fluid to drain from the other of first and second chambers 26, 28 to tank 40, a second position at which the flow directions are reversed, and a third position at which fluid flow is blocked from both of first and second chambers 26, 28. The location of proportional valve element 112 between the first, second, and third positions may determine a flow rate of the pressurized fluid directed into and out of first and second chambers 26, 28. It is contemplated that one proportional valve element 112 may control the filling and draining functions for both hydraulic cylinders 20 of second permanent fluid actuator 14 or, alternatively, that two proportional valve elements 112 may be included within second permanent valve assembly 96 and associated with each hydraulic cylinder 20. It is also contemplated that proportional valve element 112 may alternatively be omitted and multiple independent metering valves implemented that control the filling and draining functions of each of first and second chambers 26, 28 for each hydraulic cylinder 20 within second permanent fluid actuator 14.

First optional valve assembly 98 may include a first proportional valve element 122 and a second proportional valve element 124 configured to reduce pressure fluctuations within hydraulic cylinders 20 of first permanent fluid actuator 12. Specifically, first proportional valve element 122 may be in fluid communication with fluid passageway 88 via a passageway 126 and with tank 40 via a passageway 128 to selectively allow fluid within second chamber 28 of hydraulic cylinders 20 to drain to tank 40. Second proportional valve element 124 may be in fluid communication with fluid passageway 86 via a passageway 130, and with an accumulator 132 via a passageway 134 and external port 135 to selectively allow from first chamber 26 of hydraulic cylinders 20 to flow into and out of accumulator 132.

Each of first and second proportional valve elements 122, 124 may be solenoid actuated against a spring bias to move between a flow-passing position and a flow-blocking position The location of first and second proportional valve elements 122, 124 between the first and second positions may determine a flow rate of the pressurized fluid directed into and out of first and second chambers 26, 28. By selectively allowing fluid from second chamber 28 to flow to tank 40 and fluid from first chamber 26 to flow into and out of accumulator 132 during travel of work machine 10, bounce of work implement 16 may be minimized, thereby providing a more cushioned ride. It is contemplated that a single proportional valve element may alternatively control the filling and draining functions for both hydraulic cylinders 20 of first permanent valve assembly 12.

Second optional valve assembly 100 may include at least one proportional valve element 136 configured to meter the flow of fluid through optional fluid actuator 18. Specifically, proportional valve element 136 may be in fluid communication with passageway 68 via a passageway 138, with passageway 72 via a passageway 140, and with passageways 39 and 41 of optional fluid actuator 18 via passages 142, 144 and external ports 143, 145, respectively.

Proportional valve element 136 may be solenoid actuated against a spring bias to move between a first position at which pressurized fluid from source 42 is allowed to flow in a first direction through optional fluid actuator 18, a second position at which the flow direction is reversed, and a third position at which fluid flow is blocked from optional fluid actuator 18. The location of proportional valve element 136 between the first, second, and third positions may determine a flow rate of the pressurized fluid directed through optional fluid actuator 18. It is contemplated that proportional valve element 136 may alternatively be omitted and multiple independent metering valves be implemented that control the two flow directions of optional fluid actuator 18. It is further contemplated that accumulator 132 may alternatively be located internal to hydraulic valve stack 44 and external port 135 omitted, if desired.

End plate 93 may be configured to close off passageways within second optional valve assembly 100. In particular, end plate 93 may be a substantially planar plate member that is connectable to second optional valve assembly 100 to terminate fluid passageways 138, 140. End plate 93 may be removable to expand hydraulic valve stack 44 or to maintain first and second optional valve assemblies 98, 100.

Fasteners 57 may be configured to connect inlet cover 52, first and second permanent and optional valve assemblies 94-100, and end plate 93 to base member 50. In one embodiment, two fasteners 57 may extend through inlet cover 52 and first and second permanent valve assemblies 94, 96 to engage threaded bores 55 in first mounting surface 54 of base member 50. Two additional fasteners 57 may extend through end plate 93 and first and second optional valve assemblies 98, 100 to engage threaded bores 55 in second mounting surface 56 of base member 50. It is contemplated that a greater or lesser number of fasteners 57 may be implemented to connect the components of hydraulic valve stack 44 together. Upon expansion of hydraulic valve stack 44, fasteners 57 may be replaced with longer fasteners.

Hydraulic valve stack 44 may include sealing devices to restrict leakage from the valve assemblies of hydraulic valve stack 44. In particular, a sealing device such as, for example, an o-ring 146 may be disposed about each fluid passageway between inlet cover 52 and second permanent valve assembly 96, between first and second permanent valve assemblies 94, 96, between first permanent valve assembly 94 and base member 50, between base member 50 and first optional valve assembly 98, between first and second optional valve assemblies 98, 100, and between second optional valve assembly 100 and end plate 93. It is contemplated that different sealing devices such as, for example, gaskets may alternatively be implemented.

INDUSTRIAL APPLICABILITY

The disclosed hydraulic valve stack finds potential application in any system where it is desirable to fluidly interconnect multiple fluid actuators with a common source of pressurized fluid and/or a common tank. The disclosed hydraulic valve stack provides for hydraulic system expansion, while reducing the opportunity for system contamination. The disclosed hydraulic valve stack also provides for reduced labor involved in the maintenance and expansion of the hydraulic valve stack. The expansion and maintenance of hydraulic valve stack 44 will now be explained.

Hydraulic valve stack 44 may be expanded by the addition of permanent valve assemblies to control additional permanent functions or features of work machine 10. To add permanent valve assemblies, fasteners 57 that engage first mounting surface 54 of base member 50 may be removed from base member 50. The new permanent valve assembly may then be mounted between base member 50 and first permanent valve assembly 94, between first and second permanent valve assemblies 94, 96, or between second permanent valve assembly 96 and inlet cover 52. O-rings 146 may be disposed about the fluid passageways on either side of the new permanent valve assembly to restrict leakage from hydraulic valve stack 44. When adding additional permanent valve assemblies, it may be necessary to replace fasteners 57 with longer fasteners to accommodate the increased length of hydraulic valve stack 44.

Similarly, hydraulic valve stack 44 may be expanded by the addition of optional valve assemblies to control additional optional functions or features of work machine 10. To add optional valve assemblies, fasteners 57 that engage second mounting surface 56 of base member 50 may be removed from base member 50. The new optional valve assembly may then be mounted between base member 50 and first optional valve assembly 98, between first and second optional valve assemblies 98, 100, or between second optional valve assembly 100 and end plate 93. O-rings 146 may be disposed about the fluid passageways on either side of the new optional valve assembly to restrict leakage from hydraulic valve stack 44. When adding additional optional valve assemblies, it may be necessary to replace fasteners 57 with longer fasteners to accommodate the increased length of hydraulic valve stack 44.

The permanent and optional valve assemblies of hydraulic valve stack 44 may be maintained by the removal of fasteners 57 from the respective first or second mounting surface 54, 56 of base member 50, thereby providing access to the individual permanent or optional valve assemblies. The components of hydraulic valve stack 44 may then be inspected, replaced, cleaned, adjusted or otherwise maintained as periodically necessary. After accessing the permanent or optional valve assemblies and performing the required maintenance, fasteners 57 may be reassembled to the respective first or second mounting surface 54, 56.

Because access to the optional valve assemblies may be had without disassembling the permanent valve assemblies and vice versa, less contamination may be introduced into hydraulic system 38. The reduced levels of contamination may provide for longer component life of hydraulic system 38 and for increased reliability of work machine 10. Further, because only those components requiring maintenance or that are associated with the desired expansion are disassembled, the maintenance and expansion processes may be simplified, requiring less associated time and labor fees. The simplified maintenance and expansion processes may also increase the likelihood of the processes be properly completed.

It will be apparent to those skilled in the art that various modifications and variations can be made to the hydraulic valve stack of the present disclosure. Other embodiments of the hydraulic valve stack will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A hydraulic valve stack for a machine, comprising:

a base having a first mounting surface with a first set of mounting structures and a second mounting surface with a second set of mounting structures, the first set of mounting structures being spaced away from the second set of mounting structures, the base being connectable to the work machine and having at least one fluid passageway extending through the base from the first mounting surface to the second mounting surface, the first mounting surface including an inlet configured to provide the only fluid communication from a pressurized source to valves mounted on the second mounting surface;

a permanent valve assembly configured to control a permanent function of the work machine, being connectable to the first mounting surface of the base, and having at least one fluid passageway in communication with the at least one fluid passageway of the base; and an optional valve assembly configured to control an optional function of the work machine, being connectable to the second mounting surface of the base, and having at least one fluid passageway in communication with the at least one fluid passageway of the base.

2. The hydraulic valve stack of claim 1, wherein the first surface of the base is configured to receive at least a first fastener to retain the permanent valve assembly, and the second surface of the base is configured to receive at least a second fastener to retain the optional valve assembly.

3. The hydraulic valve stack of claim 2, wherein the optional valve assembly is removable without disassembly of the at least a first fastener.

4. The hydraulic valve stack of claim 1, further including an end plate connectable to the optional valve assembly and configured to close off the at least one fluid passageway of the optional valve assembly.

5. The hydraulic valve stack of claim 4, further including a plurality of optional valve assemblies, wherein each of the plurality of optional valve assemblies are connectable to each other, to the base, and to the end plate.

6. The hydraulic valve stack of claim 5, wherein each of the plurality of optional valve assemblies includes at least one fluid passageway in communication with the at least one fluid passageway of the base.

7. The hydraulic valve stack of claim 1, further including an inlet cover connectable to the work machine and to the permanent valve assembly, the inlet cover having at least one external port in fluid communication with the at least one fluid passageway of the permanent valve assembly.

8. The hydraulic valve stack of claim 7, further including a plurality of permanent valve assemblies, wherein each of the plurality of permanent valve assemblies are connectable to each other, to the base, and to the inlet cover.

9. The hydraulic valve stack of claim 8, wherein the plurality of permanent valve assemblies each include at least one fluid passageway in communication with the at least one fluid passageway of the base and the inlet cover.

10. The hydraulic valve stack of claim 7, wherein the work machine has a source of pressurized fluid and the external port is in fluid communication with the source.

11. The hydraulic valve stack of claim 7, wherein:

the work machine has a reservoir;

the at least one external port is a first external port; and the inlet cover includes a second external port in fluid communication with the reservoir.

12. The hydraulic valve stack of claim 11, wherein:

the at least one fluid passageways of the permanent valve assembly, the base, and the optional valve assembly are first fluid passageways; and the permanent valve assembly, the base, and the optional valve assembly each include at least a second fluid passageway in fluid communication with the second external port and with each other.

13. The hydraulic valve stack of claim 12, wherein the work machine has at least one permanent fluid actuator and the inlet cover includes:

a third external port in communication with the at least one permanent fluid actuator; and a fourth external port in communication with the at least one permanent fluid actuator.

14. The hydraulic valve stack of claim 13, wherein the permanent valve assembly includes:

a third fluid passageway in communication with the third external port;

a fourth fluid passageway in communication with the fourth external port; and a valve element configured to selectively connect the third and fourth fluid passageways with the first and the at least a second fluid passageways of the permanent valve assembly.

15. The hydraulic valve stack of claim 14, wherein:

the base includes:

a third fluid passageway in communication with the third fluid passageway of the permanent valve assembly; and a fourth fluid passageway in communication with the fourth fluid passageway of the permanent valve assembly; and the optional valve assembly includes:

a third fluid passageway in communication with the third fluid passageway of the base;

a fourth fluid passageway in communication with the fourth fluid passageway of the base;

at least one external port; and at least one valve element configured to meter pressurized fluid between at least one of the third and fourth fluid passageways of the optional valve assembly and the at least one external port of the optional valve assembly.

16. The hydraulic valve stack of claim 1, further including at least a first sealing device disposed between the base and the permanent valve assembly and at least a second sealing device disposed between the base and the optional valve assembly to restrict fluid leakage from the hydraulic valve stack.

17. A method of expanding a hydraulic valve stack having at least one permanent valve assembly connected to a base, the method comprising:

removing an end plate from the hydraulic valve stack without loosening the connection between the at least one permanent valve assembly and the base;

operatively connecting an optional valve assembly to the base, the base including a single inlet connected to a pump and providing the only fluid communication from the pump to the at least one permanent valve assembly and the optional valve assembly; and reassembling the end plate.

18. The method of claim 17, wherein the at least one permanent valve assembly is connected to the base via at least a first fastener and removing includes removing at least a second fastener and detaching the end plate while the at least a first fastener remains connected.

19. The method of claim 17, wherein operatively connecting includes connecting the optional valve assembly to a side of the base opposite the permanent valve assembly.

20. The method of claim 17, wherein operatively connecting includes connecting the optional valve assembly to an existing optional valve assembly that is connectable to the base.

21. A method of maintaining a hydraulic valve stack having at least one permanent valve assembly and at least one optional valve assembly connected to a base, the method comprising:

removing one of an end plate and an inlet cover from the hydraulic valve stack while at least one of the at least one permanent valve assembly and the at least one optional valve assembly remains substantially connected to the base, the base configured to provide the sole fluid communication, from a pressurized source, between the at least one permanent valve assembly and the at least one optional valve assembly;

accessing one of the at least one permanent and the at least one optional valve assembly; and reassembling the one of the end plate and the inlet cover.

22. The method of claim 21, wherein the at least one permanent valve assembly is connected to the base via at least a first fastener, the at least one optional valve assembly is connected to the base via at least a second fastener, and removing includes removing one of the at least a first fastener and the at least a second fastener and detaching the one of the end plate and the inlet cover while the other of the at least a first fastener and the at least a second fastener remains connected.

23. The method of claim 21, wherein accessing includes at least one of inspecting, cleaning, adjusting, and replacing a component of the one of the at least one permanent valve assembly and the at least one optional valve assembly.

24. A machine, comprising:

a source of pressurized fluid;

a reservoir;

at least one permanent fluid actuator;

at least one optional fluid actuator; and a hydraulic valve stack in fluid communication with the source of pressurized fluid, the reservoir, the at least one permanent fluid actuator, and the at least one optional fluid actuator, the hydraulic valve stack including:

a base having a single inlet to receive fluid from the pressurized source, the base having a first mounting surface and a second mounting surface, the first mounting surface and the second mounting surface receiving fluid from the pressurized source exclusively from the single inlet, the base being connectable to the work machine and having at least one fluid passageway extending continuously through the base from the first mounting surface to the second mounting surface, the first and second mounting surfaces including a first set of bores and a second set bores respectfully, wherein the first set of bores is not continuous with the second set of bores;

a permanent valve assembly configured to control the at least one permanent fluid actuator, being connectable to the first mounting surface of the base, and having at least one fluid passageway in communication with the at least one fluid passageway of the base; and an optional valve assembly configured to control the at least one optional fluid actuator, being connectable to the second mounting surface of the base, and having at least one fluid passageway in communication with the at least one fluid passageway of the base.

25. The machine of claim 24, wherein the first surface of the base is configured to receive at least a first fastener to retain the permanent valve assembly, and the second surface of the base is configured to receive at least a second fastener to retain the optional valve assembly.

26. The machine of claim 25 wherein the optional valve assembly is removable without disassembly of the at least a first fastener.

27. The machine of claim 24, wherein the hydraulic valve stack further includes an end plate connectable to the optional valve assembly and configured to close off the at least one fluid passageway of the optional valve assembly.

28. The machine of claim 27, wherein the hydraulic valve stack further includes a plurality of optional valve assemblies, wherein each of the plurality of optional valve assemblies are connectable to each other, to the base, and to the end plate.

29. The machine of claim 28, wherein each of the plurality of optional valve assemblies includes at least one fluid passageway in communication with the at least one fluid passageway of the base.

30. The machine of claim 24, wherein the hydraulic valve stack further includes an inlet cover connectable to the work machine and to the permanent valve assembly, the inlet cover having at least one external port in fluid communication with the at least one fluid passageway of the permanent valve assembly and the source.

31. The machine of claim 30, wherein the hydraulic valve stack further includes a plurality of permanent valve assemblies, wherein each of the plurality of permanent valve assemblies are connectable to each other, to the base, and to the inlet cover.

32. The machine of claim 31, wherein the plurality of permanent valve assemblies each include at least one fluid passageway in communication with the at least one fluid passageway of the base and the inlet cover.

33. The machine of claim 30, wherein:

the at least one external port is a first external port; and the inlet cover includes a second external port in communication with the reservoir.

34. The machine of claim 33, wherein:

the at least one fluid passageways of the permanent valve assembly, the base, and the optional valve assembly are first fluid passageways; and the permanent valve assembly, the base, and the optional valve assembly each include at least a second fluid passageway in fluid communication with the second external port and with each other.

35. The machine of claim 34, wherein the inlet cover includes:

a third external port in communication with the at least one permanent fluid actuator; and a fourth external port in communication with the at least one permanent fluid actuator.

36. The machine of claim 35, wherein the permanent valve assembly includes:

a third fluid passageway in communication with the third external port;

a fourth fluid passageway in communication with the fourth external port; and a valve element configured to selectively connect the third and fourth fluid passageways with the first and the at least a second fluid passageways of the permanent valve assembly.

37. The machine of claim 36, wherein:

the base includes:

a third fluid passageway in communication with the third fluid passageway of the permanent valve assembly; and a fourth fluid passageway in communication with the fourth fluid passageway of the permanent valve assembly; and the optional valve assembly includes:

a third fluid passageway in communication with the third fluid passageway of the base;

a fourth fluid passageway in communication with the fourth fluid passageway of the base;

at least one external port; and at least one valve element configured to meter pressurized fluid between at least one of the third and fourth fluid passageways of the optional valve assembly and the at least one external port of the optional valve assembly.

38. The machine of claim 24, wherein the hydraulic valve stack further includes at least a first sealing device disposed between the base and the permanent valve assembly and at least a second sealing device disposed between the base and the optional valve assembly to restrict fluid leakage from the hydraulic valve stack.

* * * * *